US006955058B2

(12) United States Patent
Taras et al.

(10) Patent No.: US 6,955,058 B2
(45) Date of Patent: Oct. 18, 2005

(54) REFRIGERANT CYCLE WITH TANDEM ECONOMIZED AND CONVENTIONAL COMPRESSORS

(75) Inventors: Michael F. Taras, Fayetteville, NY (US); Alexander Lifson, Manlius, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/769,161

(22) Filed: Jan. 30, 2004

(65) Prior Publication Data

US 2005/0166617 A1 Aug. 4, 2005

(51) Int. Cl.[7] ..... F25B 7/00; F25B 41/00

(52) U.S. Cl. ..... 62/175; 62/197; 62/510; 62/513

(58) Field of Search ..... 62/113, 117, 175, 62/197, 510, 513; 417/244, 248

(56) References Cited

U.S. PATENT DOCUMENTS 4,787,211 A * 11/1988 Shaw ..... 62/117
4,876,859 A 10/1989 Kitamoto
4,947,655 A * 8/1990 Shaw ..... 62/200
5,095,712 A * 3/1992 Narreau ..... 62/113
5,522,233 A * 6/1996 Nares et al. ..... 62/193
5,768,901 A * 6/1998 Dormer et al. ..... 62/175
5,875,637 A 3/1999 Paetow
6,047,556 A 4/2000 Lifson
6,206,652 B1 3/2001 Caillant
6,820,434 B1 * 11/2004 Gutheim et al. ..... 62/175

OTHER PUBLICATIONS

Systems & Advanced Technologies Engineering S.r.l., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Marc Norman
(74) *Attorney, Agent, or Firm*—Carlson, Gaskey & Olds

(57) ABSTRACT

A refrigerant cycle is provided with tandem compressors. Only some of the multiple compressors are provided with an economized cycle, and an optional unloader valve for selectively returning flow from an economizer injection port back to suction. The present invention thus provides the economized operation capabilities and benefits for a refrigerant cycle having tandem compressors, without the complexity of providing separate economizer arrangement for each of the compressors.

17 Claims, 1 Drawing Sheet

REFRIGERANT CYCLE WITH TANDEM ECONOMIZED AND CONVENTIONAL COMPRESSORS

BACKGROUND OF THE INVENTION

This invention relates to a refrigerant cycle having tandem compressors, wherein only some of the compressors are provided with economizer ports and can be utilized within an economizer cycle.

Tandem compressor refrigerant cycles are known, and have two or more compressors compressing refrigerant and delivering it to a common discharge manifold. Similarly, these compressors are drawing refrigerant from a common suction manifold. In some arrangements, oil equalization lines connecting oil sumps of the tandem compressors for oil management and suction pressure equalization lines connecting shells of the tandem compressors are employed. Tandem compressors provide flexibility to a refrigerant cycle designer, such as allowing additional levels of capacity control by turning off some of the compressors. Moreover, in some applications that would require a very large single compressor, tandem compressors provide design options, availability, and potential cost savings.

In refrigerant cycles having a single compressor, it is known to utilize an economizer circuit. The use of an economizer cycle provides system performance enhancement under certain conditions by tapping off a portion of a refrigerant flow downstream of a condenser. The tapped refrigerant is passed through a separate economizer expansion device, and then passes through an economizer heat exchanger along with the main refrigerant flow. The tapped refrigerant cools the main refrigerant flow, such that the main refrigerant flow has a greater cooling capacity when it reaches the evaporator. The tapped refrigerant is returned to the compressor at an intermediate point in the compression cycle. Furthermore, economizer cycles provide extra steps of unloading, closely matching capacity requirements as well as improve system reliability, enhance operation control and reduce life-cycle cost of equipment due to decreased number of system shutdowns. Furthermore, when an economizer cycle is combined with various means of compressor unloading, even greater benefits can be achieved. Although economizer circuits provide additional benefits to a refrigerant cycle as described above, the economizer circuits have not been incorporated into refrigerant cycles having tandem compressors, where some compressors are designed to have an intermediate injection port and some compressors are conventional non-economized compressors.

SUMMARY OF THE INVENTION

In the disclosed embodiment of this invention, a refrigerant cycle is provided with tandem compressors delivering a compressed refrigerant to a common discharge manifold, and receiving a refrigerant from a common suction manifold. For instance, if a pair of tandem compressor is considered, one of the two compressors is provided with an economizer port connected and an economizer circuit, and the other is provided in a conventional non-economized configuration. A control for the combined compressors provides variations in capacity for the refrigerant cycle by turning one or both of the compressors on or off, and operating the economized compressor either in economized or non-economized mode.

In specific applications, the economizer return line is also branched downstream of an economizer shutoff valve into an unloader line, and into an economizer injection port. The unloader line is provided with an unloader valve. Thus, the compressor that can be operated in economized operation is also capable of being unloaded.

The present invention thus provides much of the capacity control capabilities of an economized tandem compressor, without the expense of providing separate economizer circuits for each of the two compressors.

These and other features of the present invention can be best understood from the following specification and drawings, the following of which is a brief description.

DETAILED DESCRIPTION OF THE PREFERRED EMBODIMENT

Figure 1:
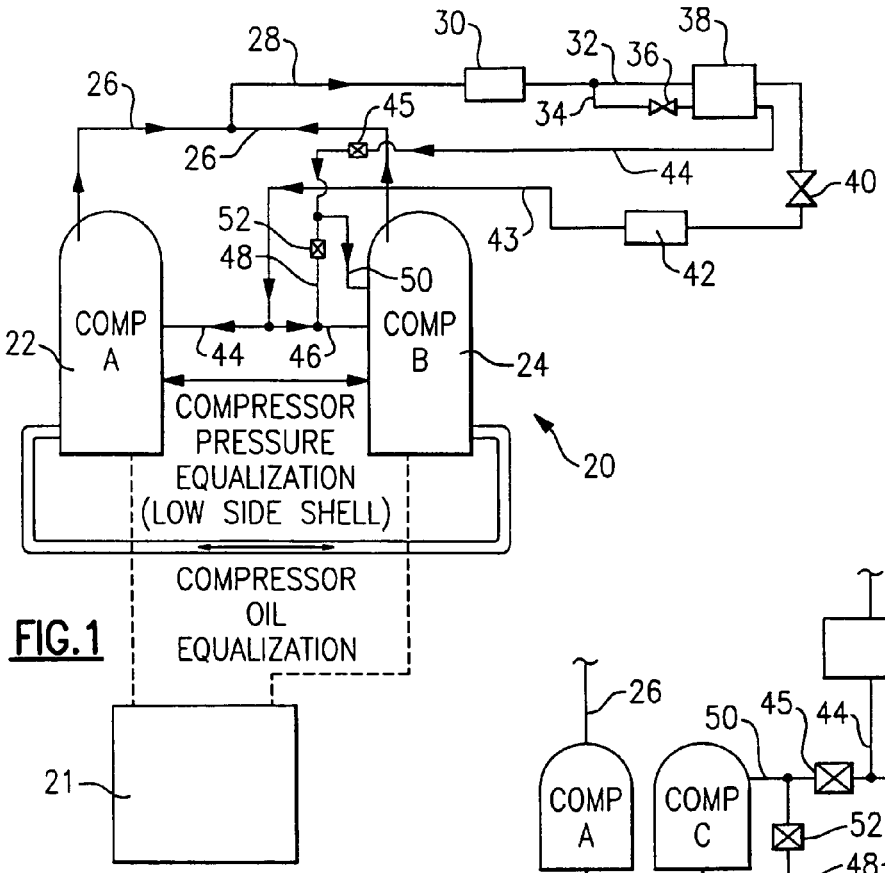
FIG. 1 is a schematic view of a refrigerant cycle incorporating the present invention.

A refrigerant cycle 20 is illustrated in FIG. 1 having a control 21 for operating two tandem compressors 22 and 24. As shown, the compressors 22 and 24 have individual discharge lines 26 leading to a common discharge manifold 28. Downstream of discharge manifold 28 is a condenser 30. A main flow line 32 downstream of the condenser 30 is branched into a refrigerant tap 34, which passes through an economizer expansion device 36. The tapped refrigerant and the refrigerant in the main flow line 32 both pass through an economizer heat exchanger 38. The main refrigerant in line 32 then passes through an expansion device 40 and an evaporator 42. As is known, the economizer circuit provides greater cooling capacity to the refrigerant main flow in line 32 when it reaches the evaporator 42. From the evaporator 42, the refrigerant enters a common suction manifold 43, and eventually individual suction lines 44 and 46 heading back to the compressors 22 and 24, respectively.

The economizer return line 44 passes through an economizer shutoff valve 45. From shutoff valve 45, the economized return line communicates to an optional unloader line 48 communicating with the suction line 46 and passing through an unloader valve 52. It should be noted that the shutoff value can also be located in the liquid portion of the economized cycle on a refrigerant tap line 34. The shut off value can also be made as part of an expansion device 40. An economizer injection line 50 communicates the refrigerant back to the compressor 24. If valve 52 is closed and valve 45 is opened, then economized operation will occur, and the refrigerant from line 44 will be returned to the compressor 22 through line 50. If unloader valve 52 is opened and valve 45 is closed, then refrigerant is by-passed from an intermediate point in the compression chambers of compressor 24 back through the open valve 52 to the suction line 46.

In case both valve 45 and 52 are open, the refrigerant from economizer line 43 and from line 50 is combined and delivered to suction line 46. Obviously, if both valves 45 and 52 are closed, conventional non-economized operation is executed.

Control 21 is able to provide several levels of capacity, namely both compressors can be operated in non-economized operation. If a greater cooling capacity is desired, then compressor 24 can be operated in economized mode. If a lesser capacity is desired, then compressor 24 can be operated in any of the unloaded modes described above. Of course, either one or both compressors can be shut down to provide even further gradations in the number of capacities available from the tandem compressors 22 and 24.

The present invention thus provides a tandem compressor arrangement for a refrigerant cycle, wherein economized operation provides enhanced system capabilities, however, the system implementation does not require full expense of providing separate economized circuits and additional costs associated with a compressor that has additional design provisions to accommodate an intermediate injection port for each compressor 22 and 24. Also, the concept of multiple compressors, with less than all having economized operation extends to cycles with more than two compressors.

As can be appreciated from FIG. 1, the compressors 23 and 24 may be connected by a pressure equalization line to equalize the pressure within the shells. Further, an oil equalization line for a similar purpose of equalizing oil between the two compressors may be included.

Figure 2:
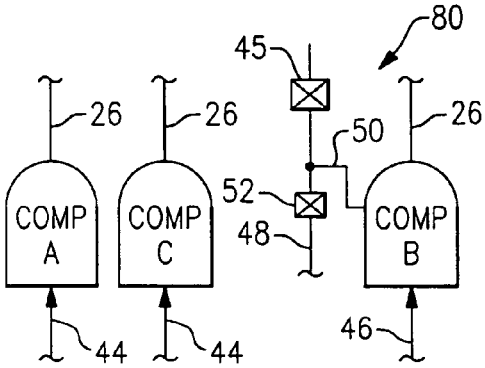
FIG. 2 is a schematic view of a second option.

FIG. 2 shows another option 80, wherein there are three or more compressors. In option 80, two of the compressors, compressor A and compressor C are not provided with the economized mode and the unloader function. Rather, only compressor B is provided with the economized mode and the unloader function. This concept can extend to even greater numbers of compressors, wherein any number are provided with the economized mode and the unloader operation, and a plurality of others are not.

Figure 3A:
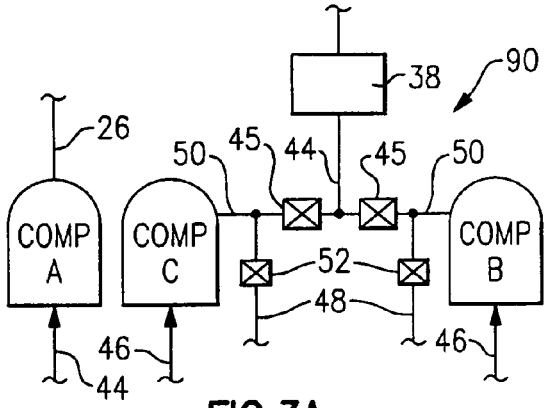
FIG. 3A is a schematic view of another option.
Figure 3B:
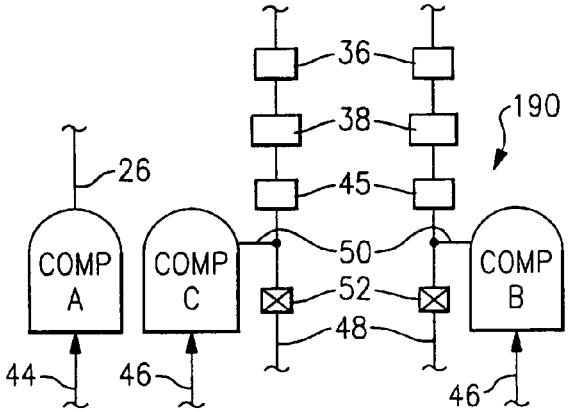
FIG. 3B is a schematic view of another option.

FIG. 3A shows another embodiment 90, wherein compressors B and C are both provided with the economized operation and the unloader function, and only compressor A is not. This concept can extend to even greater numbers of compressors, wherein a number are not provided with the economized mode and the unloader, and a plurality are. In the FIG. 3A embodiment 90, a single economizer heat exchanger 38 delivers refrigerant to the compressors B and C. In the FIG. 3B embodiment 190, it is clear that separate economizer heat exchangers 38, and economizer expansion devices 36 are associated with each compressor B and C.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

at least two compressors, said compressors having discharge ports communicating with a common discharge manifold; and suction ports communicating with a common suction manifold;

a first heat exchanger downstream of said discharge manifold;

a main flow line leaving said first heat exchanger and leading to at least one economizer heat exchanger, and at least one tap line off of said main flow line upstream of said at least one economizer heat exchange, refrigerant in said tap line and refrigerant in said main flow line both passing through said at least one economizer heat exchanger, said main refrigerant flow returning to said compressors; and refrigerant in said tap line passing to at least one of said compressors downstream of said economizer heat exchanger and not passing to at least one compressor.

2. A refrigerant cycle as set forth in claim 1, wherein an economizer shutoff valve controls flow of tapped refrigerant through said at least one economizer heat exchanger.

3. A refrigerant cycle as set forth in claim 2, wherein said shutoff valve is a solenoid valve.

4. A refrigerant cycle as set forth in claim 2, wherein said shutoff valve is part of an expansion device.

5. A refrigerant cycle as set forth in claim 1, wherein said economizer return line communicates with an intermediate compression point in said one compressor.

6. A refrigerant cycle as set forth in claim 5, wherein an unloader line communicates with said economizer return line, and has an unloader valve for selectively controlling flow through said unloader line back to a suction line returning refrigerant to said one compressor.

7. A refrigerant cycle as set forth in claim 1, wherein a control is provided with control options recognizing that said at least one compressor has economized operation as an option.

8. A refrigerant cycle as set forth in claim 1, wherein there are at least three of said compressors, with at least two not receiving refrigerant from said tap line.

9. A refrigerant cycle as set forth in claim 1, wherein there are at least three compressors, with at least two of said compressors receiving refrigerant from said tap line.

10. A refrigerant cycle as set forth in claim 9, wherein a single economizer heat exchanger delivers refrigerant to said at least two of said compressors.

11. A refrigerant cycle as set forth in claim 9, wherein at least two economizer heat exchangers deliver refrigerant separately to said at least two of said compressors.

12. A refrigerant cycle comprising:

at least two compressors, said compressors having discharge ports communicating with a common discharge manifold; and suctions ports communicating with a common suction manifold;

a first heat exchanger downstream of said discharge manifold;

a main flow line leaving said first heat exchanger and leading to at least one economizer heat exchanger, and at least one tap line off of said main flow line upstream of at least one of said economizer heat exchange, refrigerant in said tap line and refrigerant in said main flow line both passing through said at least one economizer heat exchanger, said main refrigerant flow returning to said compressors;

refrigerant in said tap line passing to at least one of said compressors downstream of said economizer heat exchanger and to an intermediate compression point, and not passing to at least one of said compressors, an economizer return valve controlling flow of said tapped refrigerant; and a control is provided with control options recognizing that said at least one compressor has economized operation as an option.

13. A refrigerant cycle as set forth in claim 12, wherein an unloader line communicates with said economizer return line, and has an unloader valve for selectively controlling flow through said unloader line back to a suction line returning refrigerant to said at least one compressor.

14. A refrigerant cycle as set forth in claim 12, wherein there are at least three of said compressors, with at least two not receiving refrigerant from said tap line.

15. A refrigerant cycle as set forth in claim 12, wherein there are at least three compressors, with at least two of said compressors receiving refrigerant from said tap line.

16. A refrigerant cycle as set forth in claim 15, wherein a single economizer heat exchanger delivers refrigerant to said at least two of said compressors.

17. A refrigerant cycle as set forth in claim 15, wherein at least two economizer heat exchangers deliver refrigerant separately to said at least two of said compressors.

* * * * *